US005471770A

United States Patent [19]

Ferreira

[11] Patent Number: 5,471,770

[45] Date of Patent: Dec. 5, 1995

[54] RUBBERIZED WEAR PAD ASSEMBLY AND METHOD OF MAKING SAME

[75] Inventor: Thomas Ferreira, Fairhaven, Mass.

[73] Assignee: F&B Enterprises, Inc., New Bedford, Mass.

[21] Appl. No.: 132,135

[22] Filed: Oct. 5, 1993

[51] Int. Cl.[6] ..... E01H 5/04

[52] U.S. Cl. ..... 37/264; 37/266; 37/233; 172/719; 172/772

[58] Field of Search ..... 37/264, 266, 233, 37/446, 460; 172/719, 772; 267/141.1

[56] References Cited

U.S. PATENT DOCUMENTS

| | | | |
|---|---|---|---|
| 2,061,585 | 11/1936 | Meyer | 37/42 |
| 2,778,129 | 1/1957 | Fryer | 37/141 R |
| 3,772,803 | 11/1973 | Cote | 37/233 |
| 3,934,654 | 1/1976 | Stephenson et al. | 37/266 X |
| 4,141,160 | 2/1979 | Olson | 37/460 |
| 4,347,677 | 9/1982 | Küper | 37/233 |
| 4,570,366 | 2/1986 | Yost | 37/270 |
| 4,819,349 | 4/1989 | Mensch | 37/117.5 |
| 4,995,598 | 2/1991 | Ingham | 267/141.1 |
| 5,012,599 | 5/1991 | DeClair et al. | 37/117.5 |
| 5,075,985 | 12/1991 | Mensch | 37/117.5 |
| 5,140,763 | 8/1992 | Nichols, IV | 37/233 |
| 5,207,010 | 5/1993 | Grossman | 37/233 X |
| 5,351,844 | 10/1994 | Carlstedt | 267/141.1 |
| 5,412,885 | 5/1995 | Cornelius | 37/466 X |

*Primary Examiner*—David H. Corbin
*Assistant Examiner*—Victor Batson
*Attorney, Agent, or Firm*—Wolf, Greenfield & Sacks

[57] ABSTRACT

A wear pad assembly for the bottom of a large machine operated device has a number of wear pads, each of which has a number of sections which are compressed and sandwiched together. The sections have an inclined front surface to assist in scooping debris or snow from a floor surface or a street. The sections are mounted in a frame which has a top plate, a pair of end plates which are perpendicular to the top plate, and a pair of rods which extend between the end plates and are parallel each other and to the top plate. The sections may include fabric reinforced rubber, molded rubber, polyurethane, or a combination of these materials.

26 Claims, 4 Drawing Sheets

RUBBERIZED WEAR PAD ASSEMBLY AND METHOD OF MAKING SAME

FIELD OF THE INVENTION

This invention relates to a large machine-operated device, such as a bucket on a front end loader, which picks up or pushes objects or material from a surface.

BACKGROUND OF THE INVENTION

Front end loaders or other large machine-operated equipment carrying a bucket, scoop, or plow are used to move objects or material from ground surfaces. When using a bucket, which is typically made of metal, significant damage can be caused not only to the bucket but also more importantly, to the ground surface, such as a concrete floor or an outdoor street over which it is scooped. Such damaged concrete floors and streets can be very expensive to replace or repair. Some users couple a metal piece to the bottom of the bucket. This piece protects the bucket, but the wear to the ground surface is still significant.

At some airports, a single molded rubber strip has been attached to the bottom of a plow for plowing runways. A typical strip is of about six inches high and about one inch thick of molded rubber is secured the depth of the bucket. This molded strip wears quickly. Since it has a greater height than thickness, it folds under the plow when used. A similarly shaped strip of plastic has also been tried.

SUMMARY OF THE INVENTION

According to the present invention, a wear pad assembly is coupled to a bottom portion of a device, such as a bucket or plow, which is used to pick up or push material over a concrete floor. A series of wear pads, each with a plurality of sections are sandwiched together along an axis transverse to the direction that the device is operated. The plurality of sections of each wear pad has about the same general cross-section. For each wear pad, a steel top plate extends along a top surface of each section. The top surface may be planar, or may have a recessed portion sized to receive the top plate. Two end plates, each with two apertures, are welded perpendicular to the top plate. Dividers extending from the plate may be provided periodically between a number of sections. A pair of rods, which are parallel to each other and to the top plate, preferably extend through each of the sections and through the apertures in the end plates.

The front surface of the sections may be inclined so that the front surface forms an acute angle relative to the bottom surface. This shape assists scooping or pushing material from the ground surface.

Preferably two to six wear pads are coupled to a bucket so that these extend along the width of the bucket. Since the sections are compressed near the top of each section, the assembly has a generally planar bottom surface since the sections flare at the bottom, although there may still be some small gap between adjacent wear pads. According to another embodiment of the present invention, the front surface of the wear pad can be inclined so that it forms an obtuse angle relative to the bottom surface. This shape may be employed for picking up certain types of sturdy material when an operator wants the metal bucket to first strike the material, rather than having the wear pad strike the material.

For each section, the thickness across the front surface facing the direction of operation is smaller than the width of the section.

Preferably, the sections are made from a fabric reinforced rubber, such as pieces of rubber tires. Some or all sections may include molded rubber or a polymer such as a polyurethane or polypropylene. One molded section of rubber or polyurethane may be used for every given number of reinforced rubber sections.

The wear pad assembly according to the present invention reduces wear on a concrete floor or street while improving the ability to pick up or push material. The front surface of the wear pad can act as a squeegee in the acute angle embodiment, thus improving pick up and removal of material. The wear pad assembly also reduces shock and vibration from the bucket striking the ground, and thus makes operation of the device more comfortable for the operator. Because of the shape of the sections in either embodiment and the compression transverse to the direction of operation, the wear pad is held rigidly relative to the bottom portion and does not fold under the device.

BRIEF DESCRIPTION OF THE DRAWINGS

Other features and advantages will become apparent from the following detailed description and from the drawings in which.

DETAILED DESCRIPTION

Figure 1:
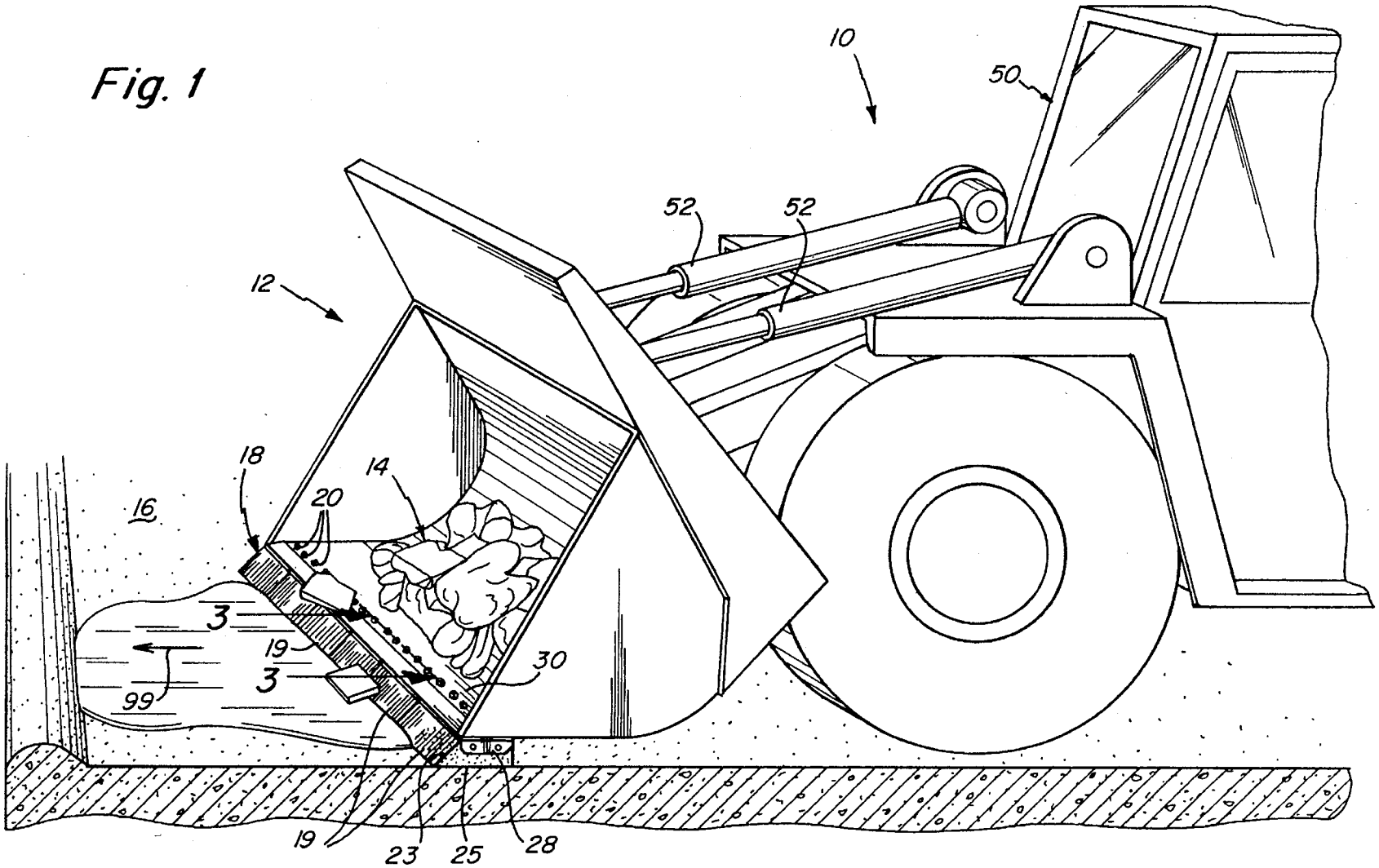
FIG. 1 is a pictorial view of a front end loader with a wear pad assembly according to the present invention.

Referring to FIG. 1, a front end loader 10 has a bucket 12 for picking up or pushing objects 14 from a ground surface 16, such as a floor or street. The bucket, which is typically made of metal, is controlled by an operator (not shown) in a cab 50. The operator moves levers which control hydraulic pistons 52 which move the bucket.

A wear pad assembly 18 has a number of wear pads 19 which are coupled to a bottom surface of the bucket with bolts 20. The wear pad assembly has a flat bottom surface 25 and a parallel top surface. The top surface abuts the bottom portion of the bucket and preferably extends along the entire width of the bucket, and is transverse to a direction of operation (indicated by arrow 99).

Figure 2:
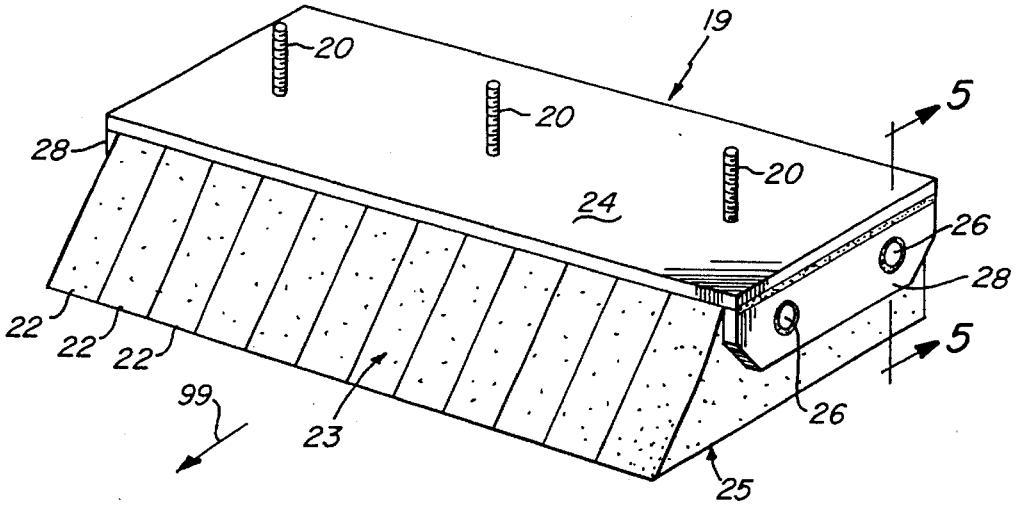
FIG. 2 is a perspective view of the wear pad shown in FIG. 1.

Referring to FIG. 2, each wear pad 19 has a number of similar sections 22. The characteristics of the wear pads are important features of this invention. The wear pads must be made of a material which will lessen the abrasion of the floor. This may be achieved by using material which is resilient and/or more susceptible to abrasion than the floor. Preferably, rubber or possibly some forms of plastic may satisfy such requirements. The most satisfactory material for these and other reasons within the scope of this invention are treads from radial truck tires or from earth moving vehicles. Thus the sections are made of a material which is durable enough not to wear quickly on a concrete surface, while not doing damage to a concrete surface, such as treads of rubber tires or from some other fabric reinforced rubber. Nylon or rayon or some other fabric is preferably used as a reinforcing material. Steel-belted tires may be used, but they are less desirable because they may cause damage to a concrete surface.

When fabric reinforced tires are used, the fabric is along one side of each section. The fabric is typically from about 6 ply up to about 30 ply for tires on large earth moving vehicles. Since the durometer of the fabric is about 20–30, and is about 40–80 for the rubber in the tires, it may be preferable to use tire treads which have fewer layers of fabric. For example, truck tires have less fabric than tires for earth moving vehicles.

Sections 22 are sandwiched together and compressed along an axis transverse to the direction of operation. The sections each have a substantially flat, inclined front surface 23 which is at an acute angle relative to the bottom surface, thus helping to scoop up material 14.

Sections 22 abut a steel top plate 24 which is substantially coextensive in surface area with the combined top surfaces of the plurality of sections. At the ends of each wear pad 19, a steel end plate 28 is welded perpendicular to top plate 24. These end plates 28 each have two apertures. Metal rods 26 extend through openings in each of the rubber sections 22 and are mounted in the apertures in the end plates.

Figure 3:
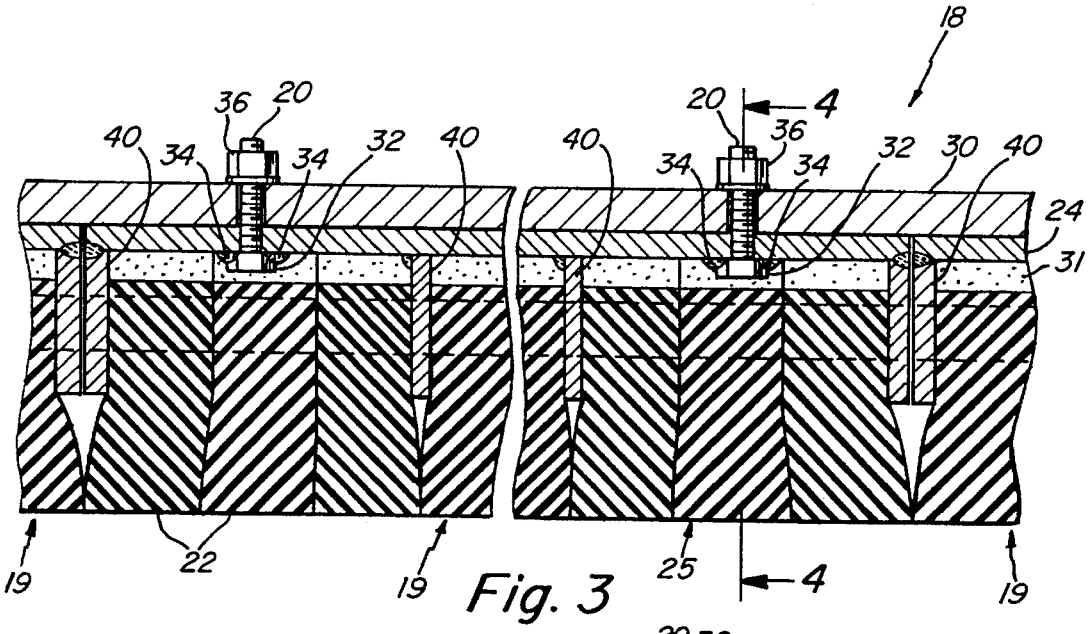
FIG. 3 is a cross-section taken along the line 3—3 in FIG. 1.
Figure 4:
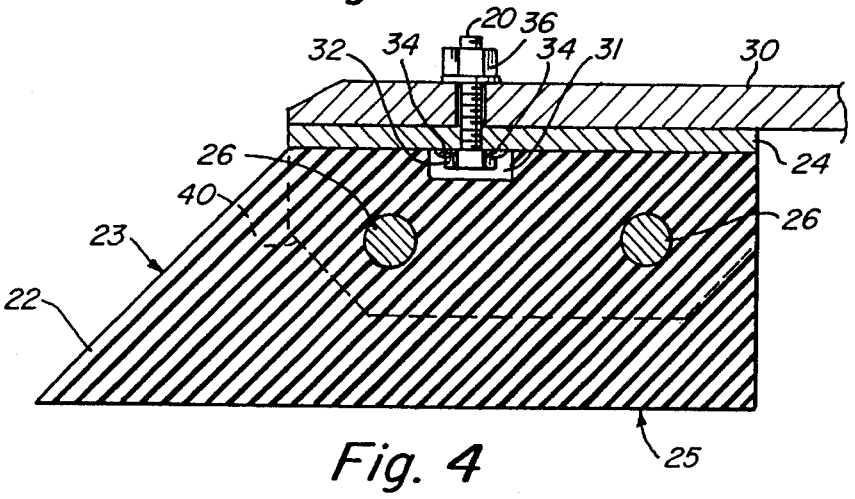
FIG. 4 is a cross-section taken along the line 4—4 of FIG. 3.

Referring to FIGS. 3 and 4, in one embodiment, top plate 24 is coupled to bottom portion 30 of the bucket with bolts 20 and nuts 36. Each bolt 20 has a head 32 which is under top plate 24 in a grooved channel 31 in the sections, and is coupled to top plate 24 with welds 34. At the top of bottom portion 30 of the bucket, nuts 36 are tightened on the bolts to connect the wear pad to the bucket.

Between some of the rubber sections 22, a plurality of steel dividers 40 are perpendicularly welded to top plate 24. The dividers may be positioned periodically, e.g., one for every three sections. When the pad is assembled, the sections and a divider are compressed before the divider is welded. Consequently, the sections adjacent the dividers have a flared portion at the bottom. Thus when two wear pads 19 are coupled to a bucket, the bottom surface provides more complete coverage on the ground surface, even though there may be a little space between the sections at the top plates due to the end plates of each wear pad and due to a gap between the wear pads. The welded dividers help to maintain the compressing force and thus also to provide additional stability to the row of sandwiched rubber pieces.

Figure 5:
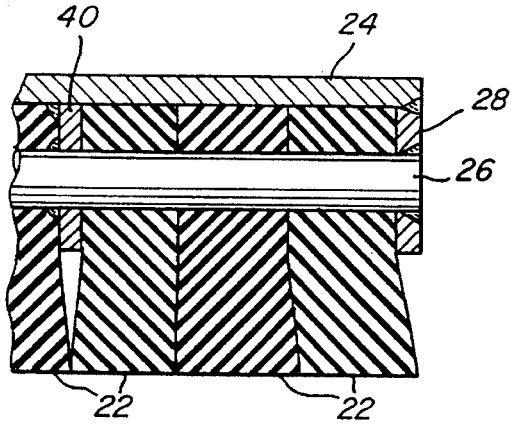
FIG. 5 is a cross-section taken along the line 5—5 of FIG. 2.

Referring to FIGS. 4 and 5, rods 26 extend longitudinally through sections 22 and dividers 40 to support the sections. Metal rod 26 extends through openings in sections 22 and support pieces 40. Rod 26 is welded to plate 28 and to support pieces 40.

A wear pad is assembled by first obtaining a top plate and drilling bolt holes. The size of the bolt holes can vary, depending on a manufacturer's specifications for the bucket or plow. The bolts are inserted in the bolt holes and the heads of the bolts are welded to the top plate. An end plate is welded perpendicular to the end of the top plate and the rods are connected to the end plate. A number of sections are placed over the rods and are stacked against the end plate. A divider is positioned on the sections, the divider and the sections are compressed, such as with a hydraulic press, and the divider is welded to the top plate. Sufficient compression is used to squeeze the sections together in a very tight abutting relation so that one section is fixed relative to its adjacent sections. This process is repeated until the other end of the top plate is reached, and the other end plate is welded to the top plate.

In a representative embodiment, each section is generally trapezoidal, having a rear height of six inches, a top width of eleven inches, a bottom width of seventeen inches, and a thickness of about two inches. The back surface is preferably perpendicular to the top and bottom surfaces. At the front surface, the pad is inclined at an angle of about 45° to the ground to assist in picking up or pushing objects or material. The holes for supporting the metal rods are 1.25 inches each in diameter, and are 6 inches apart. At the top of sections 22, a 0.75 inch deep groove is cut 5.5 inches from the back surface of the rubber sections. Steel support plate 24 is about 0.5 inches thick, eleven inches wide, and has a length which is determined by the width of the bucket and the number of wear pads to be employed. The dividers are preferably spaced about four to six inches apart. There are preferably two to six wear pads in a wear pad assembly, for a typical total length of about six to thirteen feet, depending on the bucket or plow size. When assembled, a wear pad can weigh 75 pounds per foot.

Figure 6:
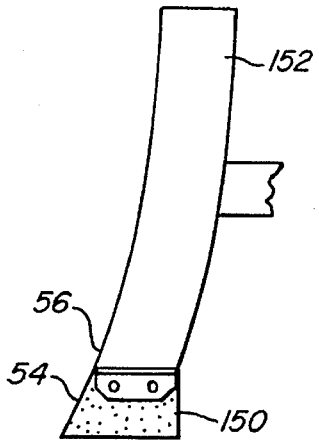
FIG. 6 is an end view of a plow with a wear pad according to a second embodiment of the present invention.

The dimensions described above may be varied depending on needs and on the size of the bucket, plow, or other device to which the wear pad assembly is coupled. Referring to FIG. 6, for example, when coupling a wear pad assembly 150 to a plow 152, it can be desirable to have a front surface 54 of the wear pad assembly at about the same angle as the bottom section 56 of the plow. The angle may be different for a plow because a plow pushes material, whereas a bucket picks up material. Another possibility is to use fewer, thicker sections rather than the two inch thick sections which are typically used currently.

Figure 7:
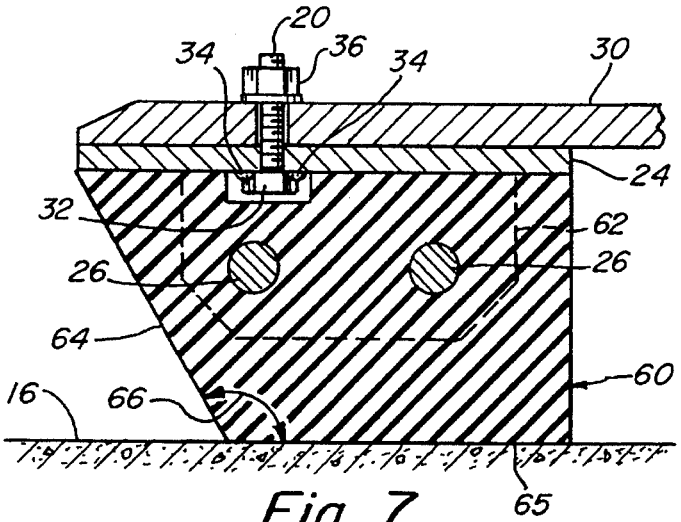
FIG. 7 is an alternative embodiment of the cross-section taken along the line 4—4 in FIG. 3.

For some types of debris or material, it may be desirable to have the metal bucket strike the material first. Referring to FIG. 7, in another embodiment, a wear pad 60 has a front surface 64 which is at an obtuse angle 66 relative to the bottom surface 65. The end plate 62, shown here in phantom, is modified compared to the embodiment of FIG. 4. Otherwise, this embodiment is similar to that shown in FIG. 4. By using a wear pad with an obtuse angle relative to the ground, the metal bucket can strike the material if desired. The wear pad still prevents the bucket from striking the ground, and reduces the impact on the ground when the bucket is lowered quickly, and does not fold under the bucket or plow when in operation.

Figure 8:
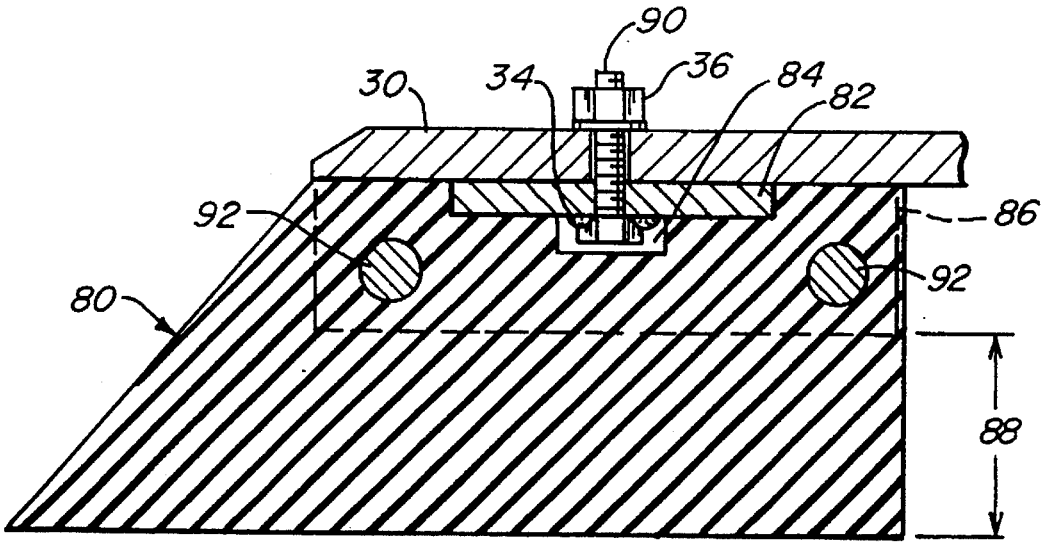
FIG. 8 is still another embodiment of the cross-section taken along the line 4—4 in FIG. 3.

Referring to FIG. 8, in another embodiment of the present invention, a top plate 82 is recessed with a first channel in section 80. A second smaller channel 84 is provided as in the embodiment of FIG. 4 for forming a space for the head of a bolt. A steel end plate 86 (in phantom) may be varied to accommodate this arrangement. In one embodiment of the wear pad according to FIG. 8, the total height of the section is about five inches and the height of the wear, represented by arrows 88, is about three inches. This embodiment has a similar wear height to the wear pad described in connection with FIG. 4, but uses less material in each section and less steel in top plate 82 since it is narrower than top plate 24 (FIG. 4). As a result, the wear pad according to FIG. 8 may be about one-third lighter than a similarly sized wear pad according to the embodiment of FIG. 4. Bucket 30, steel rods 92, bolt 90, nut 36, and weld 34 are each similar to the corresponding elements in the embodiment of FIG. 4, or can be easily adapted.

Having described an embodiment of the present invention, it should become apparent to those skilled in the art that other modifications can be made which do not depart from the scope of the appended claims. For example, the wear pad could be made from molded pieces of rubber, or from some other material such as a plastic which has strength and does not wear easily. Moreover, all or some of the sections could include a polymer such as polyurethane, polypropylene, or polyethylene. In this case, all sections, every other section, or some other ratio of polymer to rubber sections could be employed. The wear pad could also comprise sections of different materials, e.g., some could be made from used truck tire treads, and others could be molded rubber or polyurethane.

Some devices may not necessarily have a linearly transverse bottom portion, but may be angled, curved, or have a V-shaped front, particularly when the device is a plow. In this case, the axis along which the sections are sandwiched may be a curve or may have different portions, as in the case of a V-shaped front. When a plow or other device is operated at an angle relative to the travel direction of a pushing truck, the wear pad is still considered transverse the direction of operation.

According to the present invention, the wear pad assembly is tough enough to withstand abrasion from rough floor surfaces, impact with large objects that are moved or pushed, and the large downward forces from the bucket driving the wear pad into the ground surface.

What is claimed is:

1. A wear pad apparatus for use with a large machine operated device having a surface-engaging edge which is used to pick up or push material from a surface and is operated in a first direction, the apparatus comprising:

a plurality of similar abradable sections sandwiched along an axis which is transverse to the first direction; and a frame for holding the sections together along the axis in direct engagement with said edge.

2. The apparatus of claim 1 wherein at least some of the sections comprise rubber.

3. The apparatus of claim 2 wherein the frame includes a rod extending through the apertures.

4. The apparatus of claim 2 wherein the sections comprises pieces of fabric reinforced rubber tires.

5. The apparatus of claim 1 including means for locking each section in fixed relation to adjacent sections.

6. The apparatus of claim 1 wherein the sections have an inclined front surface and a bottom surface which is at an obtuse angle relative to the front surface.

7. The apparatus of claim 1 wherein the sections have an inclined front surface and a bottom surface which is at an acute angle relative to the front surface.

8. An apparatus for use with a large machine operated metal device for picking up or pushing objects on a ground surface in a first direction, the device having a bottom portion with a ground surface engaging edge to which the apparatus is coupled, the apparatus comprising:

an abradable wear pad assembly including a wear pad having a bottom surface which contacts the ground surface forward of said engaging edge in said first direction, a top surface, and an inclined front surface which contacts the objects, wherein one of the bottom surface and the top surface is larger in surface area than the other; and a frame for securing the wear pad below the engaging edge.

9. The apparatus of claim 8 wherein the wear pad comprises a material which is more abradable than and nonabrasive to a concrete surface.

10. The apparatus of claim 8 wherein the wear pad comprises rubber which is reinforced with a fabric.

11. The apparatus of claim 8 wherein the wear pad comprises a plurality of sections sandwiched and locked together along an axis transverse to the first direction.

12. The apparatus of claim 11 wherein at least some of the sections comprise reinforced rubber.

13. The apparatus of claim 11 wherein at least some of the sections comprise a polymer.

14. The apparatus of claim 11 wherein the top surfaces of the sections are generally planar, and wherein the frame comprises a top plate abutting the top surfaces of the sections.

15. The apparatus of claim 8 wherein the wear pad comprises at least one piece of molded material comprising rubber.

16. The apparatus of claim 9 wherein the frame comprises a top plate which abuts the bottom portion of the device and abuts the top surface of the wear pad.

17. The apparatus of claim 16 wherein the frame further comprises two end plates perpendicular to the top plate and extending away from the bottom portion of the device.

18. A method for making a wear pad for a large machine operated device, the method comprising the steps of:

providing a frame and a plurality of like sections cut from the reinforced sidewall or tread of a vehicular tire;

stacking at least some of the sections;

compressing the sections together so that the sections are sandwiched together; and coupling the sections to the frame.

19. The method of claim 18 wherein the compressing step comprises compressing a number of the sections and coupling a dividing plate to the frame and against one of the sections.

20. The method of claim 19 wherein the frame has a top plate, the method further comprising the steps of repeating the compressing step until the sections extend along the length of the plate.

21. An apparatus for lessening the abrasion on a concrete or asphalt surface caused by movement over the surface of a metal scoop or the like, the apparatus comprising:

a plurality of parallel abradable sections arranged lengthwise to form a common forward wall and a planar base, at least some of the sections including a main material and an abradable reinforcing material, the reinforcing material having a durometer which is less than the durometer of the main material; and means for securing the sections together.

22. In a wear pad assembly, a section coupled to the bottom lead edge of a machine-operated device used to push or pick up objects from a ground surface in a first direction, the section having a generally polygonal shaped face, and walls normal thereto defining a thickness of the section which is less than the maximum length along any of the walls.

23. A wear pad apparatus for use with a large, machine-operated device which is used to pick up or push material from a surface and is operated in a first direction, the apparatus to be coupled to the device, the apparatus comprising:

a plurality of similar sections sandwiched along an axis which is transversed to the first direction, with each of said similar sections having a thickness which is parallel to the ground and perpendicular to the first direction, and a width which is parallel to the first direction, wherein the width is greater than the thickness; and a frame for holding the sections together along the axis.

24. An apparatus for use with a large, machine-operated metal device for picking up or pushing objects on a ground surface in a first direction, the device having a bottom portion to which the apparatus is coupled, the apparatus comprising:

a wear pad assembly including a wear pad having a bottom surface which contacts the ground surface, a top surface, and an inclined front surface which contacts the objects, wherein one of the bottom surface and the top surface is larger in surface area than the other, said wear pad comprising a plurality of sections; and a frame for holding the wear pad wherein the frame comprises a top plate which abuts the bottom portion of the device and abuts the top surface of the wear pad, and further comprising two end plates perpendicular to the top plate and extending away from the bottom portion of the device.

25. The apparatus of claim 24 wherein each section has an aperture, the frame further comprising a rod which is coupled to each end plate and which extends through at least some of the apertures.

26. An apparatus for use with a large, machine-operated metal device for picking up or pushing objects on a ground surface in a first direction, the device having a bottom portion to which the apparatus is coupled, the apparatus comprising:

a wear pad assembly including a wear pad having a bottom surface which contacts the ground surface, a mop surface, and an inclined front surface which contacts the objects, wherein one of the bottom and the top surface is larger in surface area than the other, said wear pad further comprising a plurality of sections sandwiched along an axis transversed to the first direction, said top surfaces of said sections having a recessed portion and a non- recessed portion; and a frame for holding the wear pad, said frame comprising a top plate which abuts the recessed portion of the sections so that the non-recessed portions of the top surfaces of the sections and the top surface of the top plate are generally planar.

* * * * *